US012668941B2

(12) United States Patent
Luo et al.

(10) Patent No.: US 12,668,941 B2
(45) Date of Patent: Jun. 30, 2026

(54) ANNULAR ANCHOR RECYCLING INSTRUMENT AND ANNULAR ANCHOR RECYCLING METHOD

(71) Applicant: CHINA THREE GORGES CORPORATION, Wuhan (CN)

(72) Inventors: Lunbo Luo, Wuhan (CN); Changping Sun, Wuhan (CN); Bojin Tang, Wuhan (CN); Zengjuan Lei, Wuhan (CN); Jianping Zeng, Wuhan (CN); Zhi Li, Wuhan (CN); Xingzheng Zhou, Wuhan (CN); Mengchao Li, Wuhan (CN); Tong Wang, Wuhan (CN); Liyan Fan, Wuhan (CN); Yifeng Lin, Wuhan (CN); Qiuju Sun, Wuhan (CN); Min Lin, Wuhan (CN)

(73) Assignee: CHINA THREE GORGES CORPORATION (CN)

( * ) Notice: Subject to any disclaimer, the term of this patent is extended or adjusted under 35 U.S.C. 154(b) by 405 days.

(21) Appl. No.: 18/222,260

(22) Filed: Jul. 14, 2023

(65) Prior Publication Data

US 2024/0337085 A1 Oct. 10, 2024

(30) Foreign Application Priority Data

Apr. 7, 2023 (CN) ..... 202310387613.4

(51) Int. Cl.
*E02D 9/02* (2006.01)
*E02D 11/00* (2006.01)

(52) U.S. Cl.
CPC ..... *E02D 9/02* (2013.01); *E02D 11/00* (2013.01)

(58) Field of Classification Search
CPC ..... E02D 9/02; E02D 11/00
See application file for complete search history.

(56) References Cited

U.S. PATENT DOCUMENTS 6,719,496 B1 * 4/2004 Von Eberstein ..... B63B 21/22 114/296
7,527,455 B2 * 5/2009 Raines ..... B63B 21/29 405/224.1
12,098,550 B2 * 9/2024 Damiani ..... B28B 1/02
(Continued)

FOREIGN PATENT DOCUMENTS

CN 107905238 A * 4/2018 ..... E02D 15/08
CN 108425379 A * 8/2018 ..... E02D 27/525
(Continued)

*Primary Examiner* — Marc Q Jimenez
*Assistant Examiner* — Jovon E Hayes

(57) ABSTRACT

The present disclosure provides an annular anchor recycling instrument and an annular anchor recycling method, relating to the technical field of ocean engineering. The annular anchor recycling instrument includes a recycling tube, a pump body assembly, a lifting portion and an installation portion. One end of the recycling tube is provided with a cover body, and the other end of the recycling tube is configured to be an open end for cooperating with the top of the annular anchor. The pump body assembly is arranged on the cover body, and used to boost pressure to the interior of the recycling tube. The lifting portion is arranged on the cover body, and used to connect with a hoist. The installation portion are arranged on the cover body, and used to connect with the anchor chain on the annular anchor.

12 Claims, 6 Drawing Sheets

(56) References Cited

U.S. PATENT DOCUMENTS

| | | | | |
|---|---|---|---|---|
| 2016/0289911 | A1* | 10/2016 | Han | E02D 23/04 |
| 2024/0337083 | A1* | 10/2024 | Luo | E02D 7/20 |
| 2024/0337084 | A1* | 10/2024 | Luo | E02D 7/20 |
| 2024/0337085 | A1* | 10/2024 | Luo | E02D 11/00 |

FOREIGN PATENT DOCUMENTS

| | | | | | |
|---|---|---|---|---|---|
| CN | 208379607 | U | * | 1/2019 | |
| CN | 111101521 | A | * | 5/2020 | E02D 17/04 |
| CN | 212473817 | U | * | 2/2021 | |
| CN | 217778903 | U | * | 11/2022 | |
| KR | 20150049172 | A | * | 5/2015 | E02B 17/00 |
| KR | 20220100336 | A | * | 7/2022 | E02D 27/525 |
| WO | WO-9925606 | A2 | * | 5/1999 | B63B 21/26 |
| WO | WO-02062653 | A1 | * | 8/2002 | B63B 21/22 |

* cited by examiner

ANNULAR ANCHOR RECYCLING INSTRUMENT AND ANNULAR ANCHOR RECYCLING METHOD

CROSS-REFERENCE TO RELATED APPLICATION

This application claims priorities from the Chinese patent application 2023103876134 filed Apr. 7, 2023, the content of which is incorporated herein in the entirety by reference.

TECHNICAL FIELD

The present disclosure relates to the technical field of ocean engineering, in particular to an annular anchor recycling instrument and an annular anchor recycling method.

BACKGROUND

With the gradual development of offshore wind farms and offshore oil exploitation fields toward deep sea, floating anchoring foundations in various forms have been widely applied and spread, mainly including a drag flatten anchor, a suction anchor and a dynamic anchor. Among them, the suction anchor is widely used due to its convenient construction, high cost performance, recyclability and other advantages.

The suction anchor typically has a cylindrical body closed at the upper end and opened at the lower end, due to its own structural properties, the suction anchor can only reach the seabed surface during the descent, but the closed structure at the upper end makes it difficult to move further downwards. In view of anti-erosion and big torque caused by non-coplanar loads, a late-model anchor body structure has been designed, that is, an annular anchor body opened at its upper and lower ends, which is installed to a certain depth below the seabed to take advantage of the high load-bearing strength of deeper soil. However, the annular anchors installed below the seabed are more difficult to be recycled after ending its functioning; if a hoist provides a big pulling force for lifting, it functions with an excessively big pulling force with slow speed and low efficiency.

SUMMARY

Therefore, the technical problem to be solved by the present disclosure, providing an annular anchor recycling instrument and an annular anchor recycling method, is to overcome the defect of the prior art that: if a hoist provides a pulling force for lifting the annular anchors installed below the seabed, it functions with an excessively big pulling force with slow speed and low efficiency.

In order to solve the above technical problem, the present disclosure provides an annular anchor recycling instrument configured to cooperatively install an annular anchor opened at its upper and lower ends, comprising

- an recycling tube, one end of which is provided with a cover body, and the other end of which is configured to be an open end for cooperating with the top of the annular anchor;
- a pump body assembly arranged on the cover body, and used to boost pressure to the interior of the recycling tube;
- a lifting portion arranged on the cover body, and used to connect with a hoist; and
- an installation portion in multiple groups, which are arranged on the cover body, and used to connect with the anchor chain on the annular anchor, so that the annular anchor is coaxially fixed to the open end of the recycling tube.

Optionally, it further includes a constraint means, positioned at the open end of the recycling tube, which is used to limit the relative movement between the annular anchor and the recycling tube in the radial direction.

Optionally, the constraint means includes a constraint plate, one end of which is connected with the inner wall of the open end of the recycling tube, and the other end of which is suitable for protruding into the interior of the annular anchor, so as to abut on the inner wall of the annular anchor.

Optionally, the constraint plates are configured to be in multiple groups, which are spaced along the circumferential direction of the recycling tube.

Optionally, the bottom end of the constraint plate is provided with a guiding portion bent toward its center.

Optionally, the end face of the open end of the recycling tube and the end face of the annular anchor are butted to each other.

Optionally, the lifting portions in multiple groups are arranged symmetrically with respect to the circumferential direction of the cover body.

Optionally, the installation portion has multiple groups of installation points, which are arranged sequentially along the binding direction of the anchor chain.

Optionally, the side wall of the recycling tube is provided with tube connecting portions, which are arranged in multiple groups in correspondence to the installation portion.

Optionally, the present disclosure provides an annular anchor recycling method using the annular anchor recycling instrument as any one of described above, comprising the steps of:

- connecting a hoist with the lifting point on the cover body, then hoisting the recycling tube into water to sink it;
- during the descent, actuating the pump body assembly to drain water in the recycling tube to form a pressure difference between the inside and outside the recycling tube, sinking the recycling tube above the annular anchor to be recycled under the action of the pressure difference, then butting the open end of the recycling tube to the top of the annular anchor;
- connecting the installation point on the cover body with the anchor chain on the annular anchor by means of an underwater robot to fix the annular anchor coaxially to the open end of the recycling tube; and
- starting the pump body assembly to fill water into the recycling tube for a pressure boost, meanwhile cooperating with a hoist to pull the recycling tube and the annular anchor out of the seabed.

The technical solution of the present disclosure has the following advantages:

1. The annular anchor recycling instrument provided by the present disclosure is configured to cooperatively recycle the annular anchor opened at its upper and lower ends, one end of the recycling tube is provided with the cover body, on which the pump body assembly, the lifting portion and the installation portion are arranged, and the annular anchor is butted to the open end of the recycling tube. The annular anchor is fixed coaxially to the open end of the recycling tube by means of the connection between the anchor chain and the installation portion; the pump body assemble under control achieves filling water to boost pressure in the recycling tube, and drives the annular anchor to rise, so as to achieve the recycling, which is executed fast and less noisily, less impacts on the environment, and there is no need to penetrate the cover body to the level of the seabed. The height of the recycling tube can appropriately increase, avoiding the recycling tube from being jammed with soil in the process of negative pressure penetration, and the soil from being sucked into the pump body assembly to damage the equipment resultantly.

2. The annular anchor recycling instrument provided by the present disclosure also includes the constraint means, positioned at the open end of the recycling tube, which is used to limit the relative movement between the annular anchor and the recycling tube in the radial direction, so as to avoid excessive resistance to ascent after misalignment.
3. In the annular anchor recycling instrument provided by the present disclosure, the constraint means includes multiple groups of constraint plates, which are spaced along the circumferential direction of the recycling tube to abut on the inner wall of the annular anchor, avoiding the annular anchor from shaking during movement with a simple structure and high stability.
4. In the annular anchor recycling instrument provided by the present disclosure, the bottom end of the constraint plate is provided with the guiding portion bent toward its center, which is configured to lock the annular anchor in advance, avoiding the annular anchor from tilting and resultant difficult butting junction.
5. In the annular anchor recycling instrument provided by the present disclosure, the end face of the open end of the recycling tube and the end face of the annular anchor are reciprocally arranged, avoiding the movement of the annular anchor in its axial direction during recycling, from affecting recycling efficiency.
6. In the annular anchor recycling instrument provided by the present disclosure, the lifting portions in multiple groups are arranged symmetrically with respect to the circumferential direction of the cover body, and the arrangement of multiple groups of lifting portions enhances the stability of the hoisting process and further raises the accuracy of butting to the annular anchor to be recycled.
7. In the annular anchor recycling instrument provided by the present disclosure, the installation portion has multiple groups of installation points, which are arranged sequentially along the binding direction of the anchor chain, and the arrangement of multiple groups of installation points enhances the stability of binding.
8. In the annular anchor recycling instrument provided by the present disclosure, the tube connecting portion is arranged on the side wall of the recycling tube to further fix the anchor chain, avoiding the anchor chain from shaking on the side wall of the recycling tube and ensuring the stability of the recycling process.
9. In the annular anchor recycling method provided by the present disclosure, the annular anchor recycling instrument is used to sink the recycling tube above the annular anchor by means of a hoist, and fix the annular anchor to the open end of the recycling tube by means of the anchor chain; then the pump body assembly starts to fill water and boost pressure, while the hoist lifts the recycling tube and the annular anchor cooperatively and pull them out of the seabed together, so as to recycle them fast and less noisily, and possibly reuse the recycling instrument, reducing costs.

BRIEF DESCRIPTION OF THE DRAWINGS

To describe the embodiments of the present disclosure or the technical solutions in the prior art more clearly, the following briefly introduces the accompanying drawings required for describing the embodiments or the descriptions in the prior art. Apparently, the accompanying drawings in the following description show merely some embodiments of the present disclosure, and a person of ordinary skill in the art may still derive other drawings from these accompanying drawings without creative efforts.

Where, 1—annular anchor; 2—recycling tube; 3—cover body; 4—pump body assembly; 5—lifting portion; 6—installation portion; 7—anchor chain; 8—constraint means; 9—constraint plate; 10—guiding portion; 11—tube connecting portion.

DETAILED DESCRIPTION OF SOME EMBODIMENTS

The technical solutions in the embodiments of the present disclosure will be clearly and completely described as follows in combination with the drawings in the examples of the present disclosure, but obviously, the described examples are only a part of the embodiments of the present disclosure, rather than all the embodiments. Based on the examples of the present disclosure, all other examples obtained by a person skilled in the art without creative efforts shall fall within the protection scope of the present disclosure.

Furthermore, the technical features involved in different embodiments of the present disclosure described as follows can be combined with each other as long as they do not conflict with each other.

The annular anchor recycling instrument provided by the present disclosure is configured to cooperatively recycle the annular anchor opened at its upper and lower ends.

Figure 1:
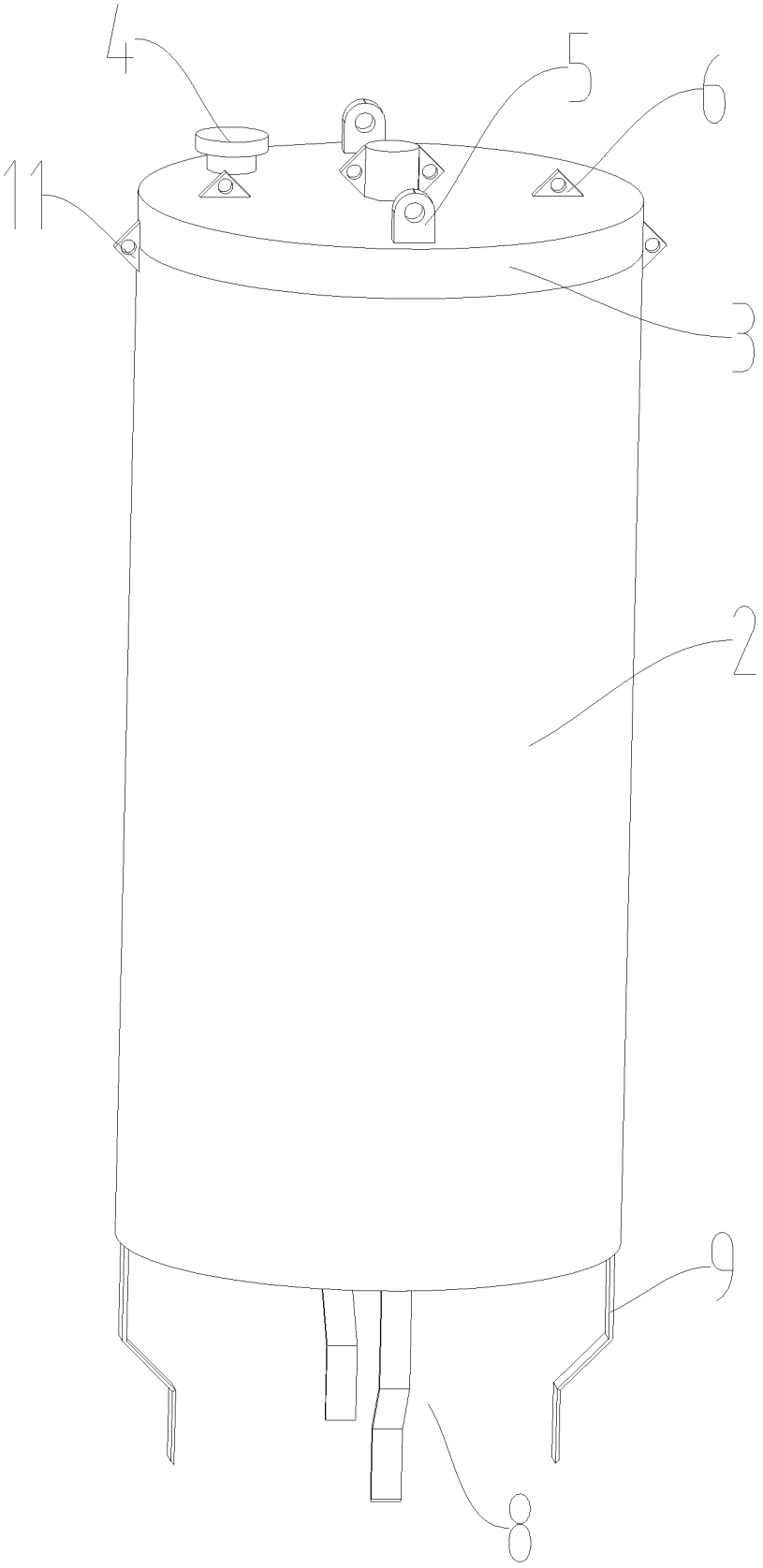
FIG. 1 is a structural schematic view of one specific embodiment of the annular anchor recycling instrument provided in the example of the present disclosure.
Figure 2:
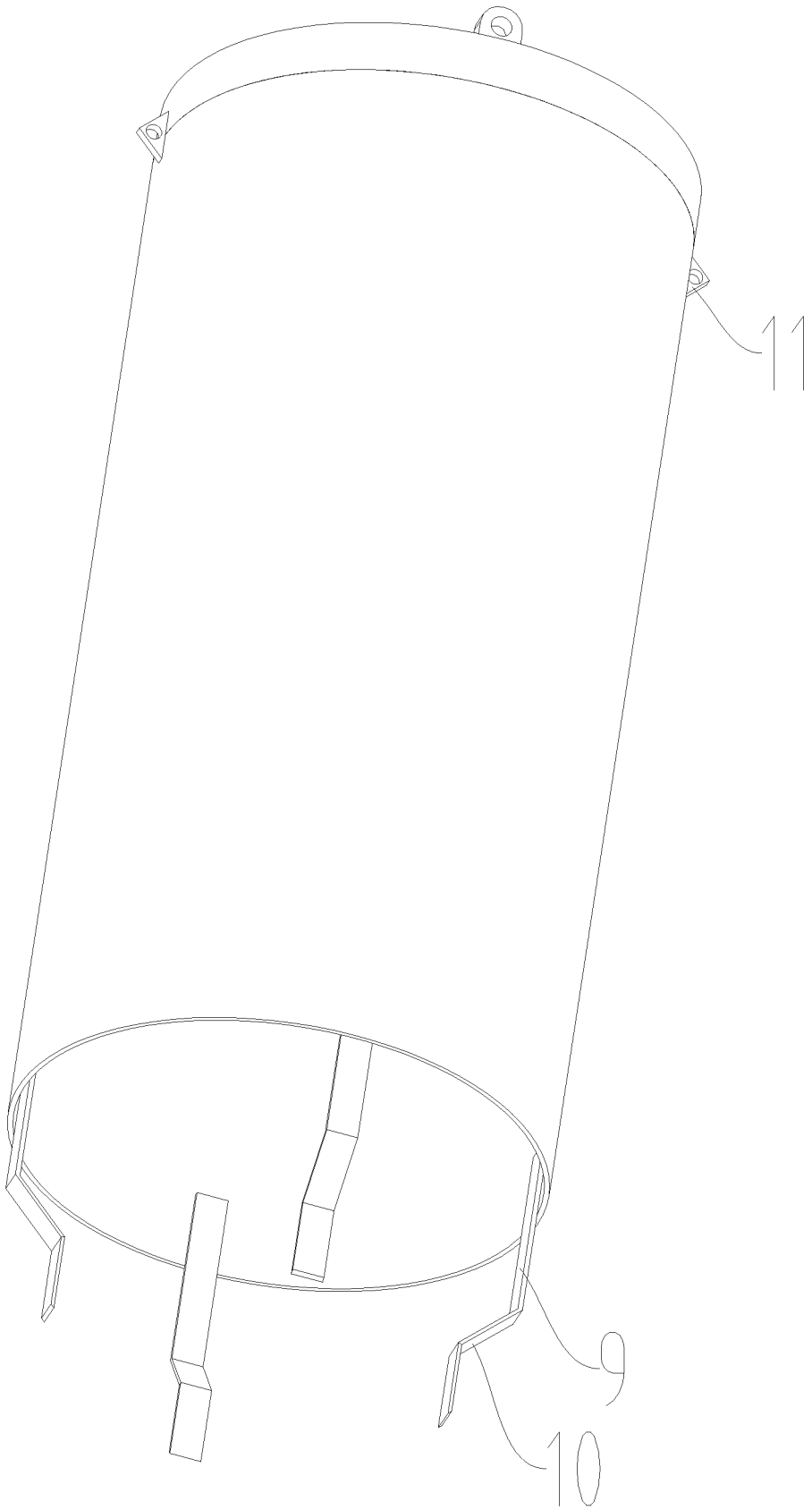
FIG. 2 is a structural schematic view of the annular anchor recycling instrument in FIG. 1 at another angle of view.
Figure 3:
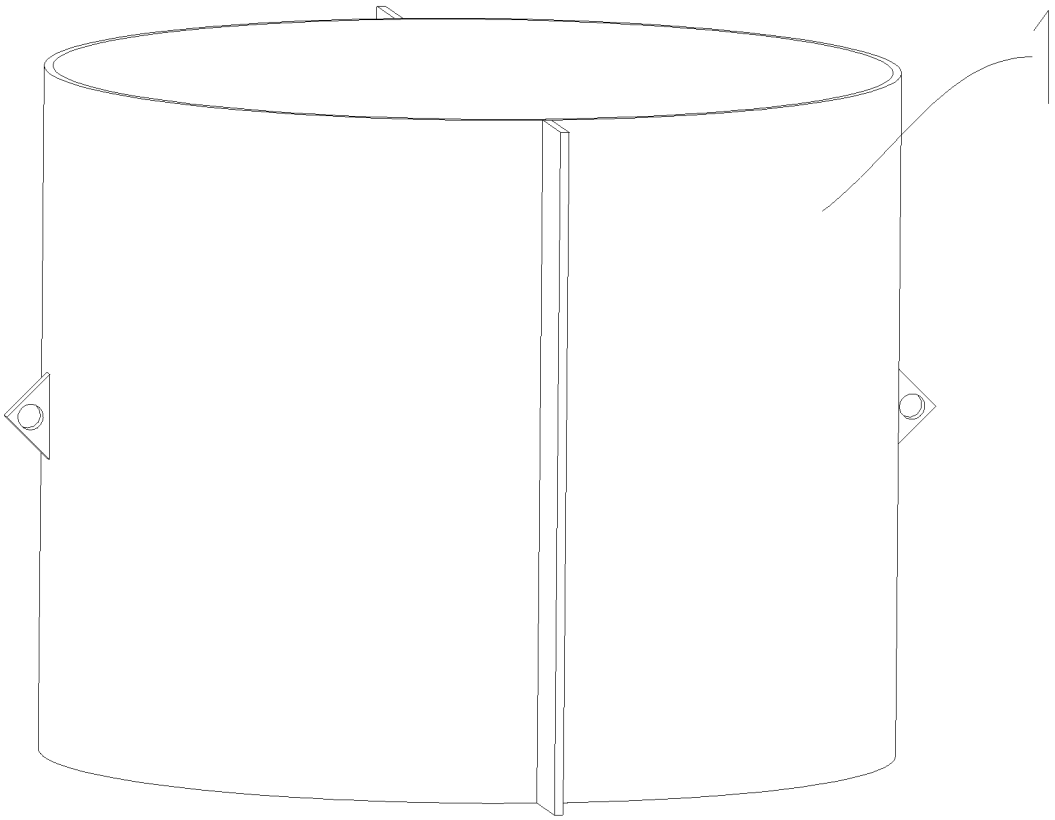
FIG. 3 is a structural schematic view of the annular anchor to be recycled.

As shown in FIGS. 1-3, one embodiment of the annular anchor recycling instrument provided by this example includes the recycling tube 2, the pump body assembly 4, the lifting portion 5 and installation portion 6. One end of the recycling tube 2 is provided with the cover body 3, and the other end of the recycling tube 2 is configured to be an open end for cooperating with the top of the annular anchor 1. The height dimension of the recycling tube 2 is greater than the distance dimension between the top of the installed annular anchor 1 and the seabed. The pump body assembly 4 is arranged on the cover body 3, and used to boost pressure to the interior of the recycling tube 2. The lifting portion 5 is arranged on the cover body 3, and used to connect with a hoist. The installation portion 6 in multiple groups are arranged on the cover body 3, and used to connect with the anchor chain 7 on the annular anchor 1, so that the annular anchor 1 is coaxially fixed to the open end of the recycling tube 2.

The annular anchor 1 is butted to the open end of the recycling tube 2. The annular anchor 1 is fixed coaxially to the open end of the recycling tube 2 by means of the connection between the anchor chain 7 and the installation portion 6; the pump body assemble 4 under control achieves filling water to boost pressure in the recycling tube 2, and drives the annular anchor 1 to rise, so as to achieve the recycling, which is executed fast and less noisily, less impacts on the environment, and there is no need to penetrate the cover body 3 to the level of the seabed. The height of the recycling tube 2 can appropriately increase, avoiding the recycling tube 2 from being jammed with soil in the process of negative pressure penetration, and the soil from being sucked into the pump body assembly 4 to damage the equipment resultantly.

Specifically, the open end of the recycling tube 2 is adapted to the shape of the top of the annular anchor 1 to be recycled, and after the recycling tube 2 and the annular anchor 1 are fixed with each other, the annular anchor 1 regarded as a part of the recycling tube 2 can be recycled together with the recycling tube 2. The lifting portion 5 and the installation portion 6 can be configured to be a lifting lug structure for respective connection with the hoist and the anchor chain.

As shown in FIGS. 1-2, the annular anchor recycling instrument provided by this example also includes the constraint means 8, positioned at the open end of the recycling tube 2, which is used to limit the relative movement between the annular anchor 1 and the recycling tube 2 in the radial direction, so as to avoid excessive resistance to the ascent caused by reciprocal misalignment between the annular anchor and the recycling tube in the process of the annular anchor rising driven by the annular anchor recycling instrument.

As shown in FIGS. 1-2, in the annular anchor recycling instrument provided by this example, the constraint means 8 includes the constraint plate 9, one end of which is connected with the inner wall of the open end of the recycling tube 2, and the other end of which is suitable for protruding into the interior of the annular anchor 1, so as to abut on the inner wall of the annular anchor 1, avoiding the annular anchor from shaking during movement, with a simple structure and high stability. Specifically, the constraint plate 9 may be configured to be a rectangular structure, or a curved plate structure adapted to the inner wall of the annular anchor 1. In addition, as an alternative embodiment, one end of the constraint plate 9 may also be arranged on the outer wall of the open end of the recycling tube 2, the other end of the constraint plate 9 abuts on the outer wall of the annular anchor 1, so as to constrain the movement of the annular anchor 1 from the outside of the annular anchor 1.

This example provides multiple sets of constraint plates 9, which are spaced along the circumferential direction of the recycling tube 2, guaranteeing the constraint on the annular anchor 1 in all directions. In addition, as an alternative embodiment, the constraint plate 9 can also be configured to be a group of cylindrical structures.

As shown in FIGS. 1-2, in the annular anchor recycling instrument provided by this example, the bottom end of the constraint plate 9 is provided with the guiding portion 10 bent toward its center, which is configured to lock the annular anchor 1 in advance, avoiding the annular anchor 1 from tilting and resultant difficult butting junction.

The end face of the open end of the recycling tube 2 and the end face of the annular anchor 1 provided by this example are butted and abutted to each other, avoiding the movement of the annular anchor 1 in its axial direction during installation from affecting recycling efficiency.

As shown in FIG. 1, in the annular anchor recycling instrument provided by the present disclosure, the lifting portions 5 in multiple groups are arranged symmetrically with respect to the circumferential direction of the cover body 3, and the arrangement of multiple groups of lifting portions 5 enhances the stability of the hoisting process and further raises the accuracy of butting to the annular anchor 1 to be recycled. Specifically, the lifting portions 5 may be arranged at the top edge of the cover body 3, and multiple groups of lifting portions 5 are arranged symmetrically to further enhance the stability of the hoisting process.

As shown in FIG. 1, in the annular anchor recycling instrument provided by this example, the installation portion 6 has multiple groups of installation points, which are arranged sequentially along the binding direction of the anchor chain 7, and the arrangement of multiple groups of installation points enhances the stability of the binding of the anchor chain 7. Specifically, one group of installation points is arranged in the middle of the top surface of the cover body 3, while the other group of installation points is arranged at the edge of the top surface of the cover body 3, so multiple groups of installation points are used to bind the anchor chain 7, providing a better binding effect.

As shown in FIG. 1, in the annular anchor recycling instrument provided by this example, the side wall of the recycling tube 2 is provided with the tube connecting portions 11, which are arranged in multiple groups in correspondence to the installation portion 6. The anchor chain is further fixed through this structure, which avoids the anchor chain 7 from shaking on the side wall of the recycling tube 2, further ensuring the stability of the recycling process.

Figure 4:
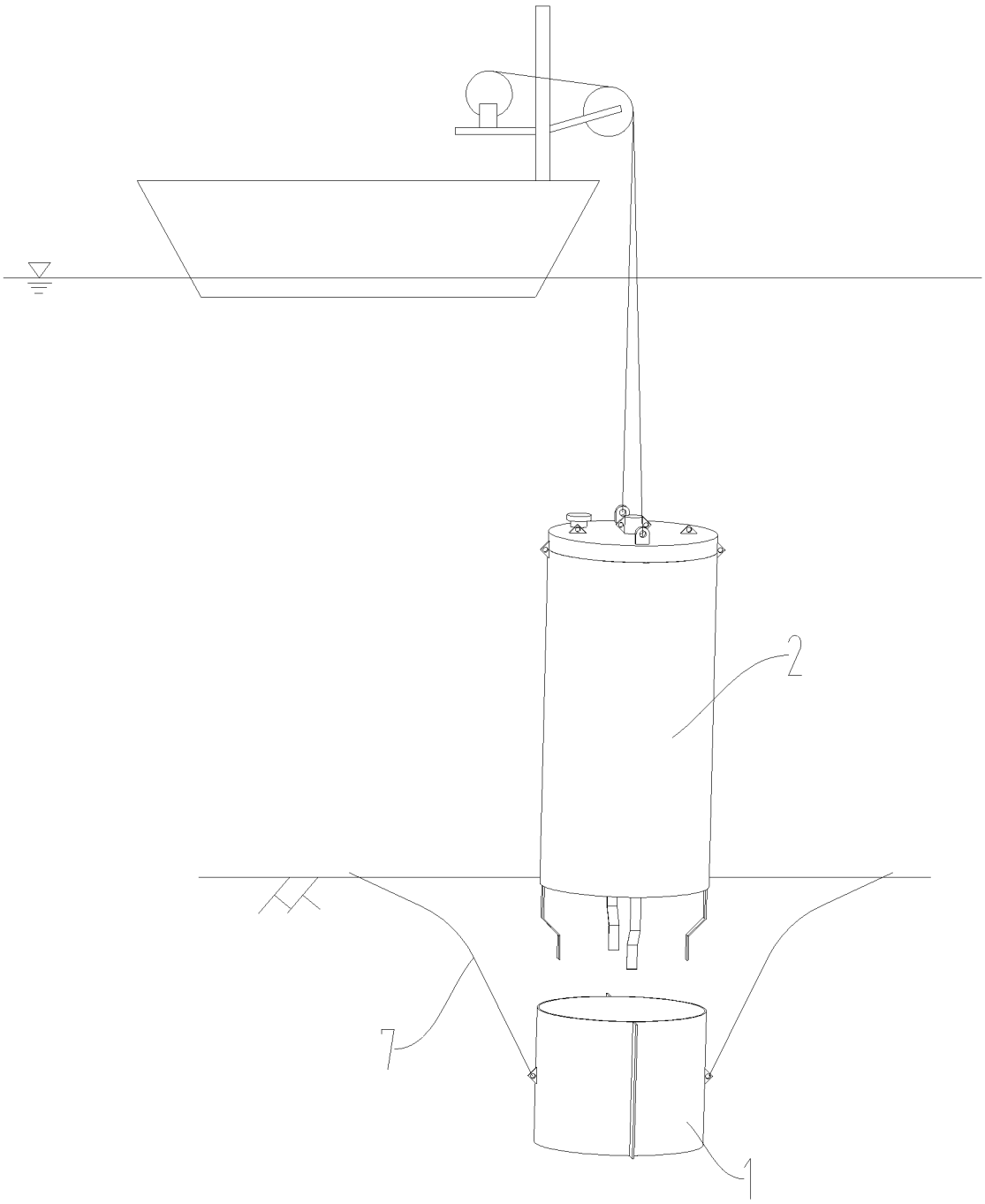
FIG. 4 is a structural schematic view of the annular anchor recycling instrument shown in FIG. 1 having sunk into water before butting to the annular anchor.
Figure 5:
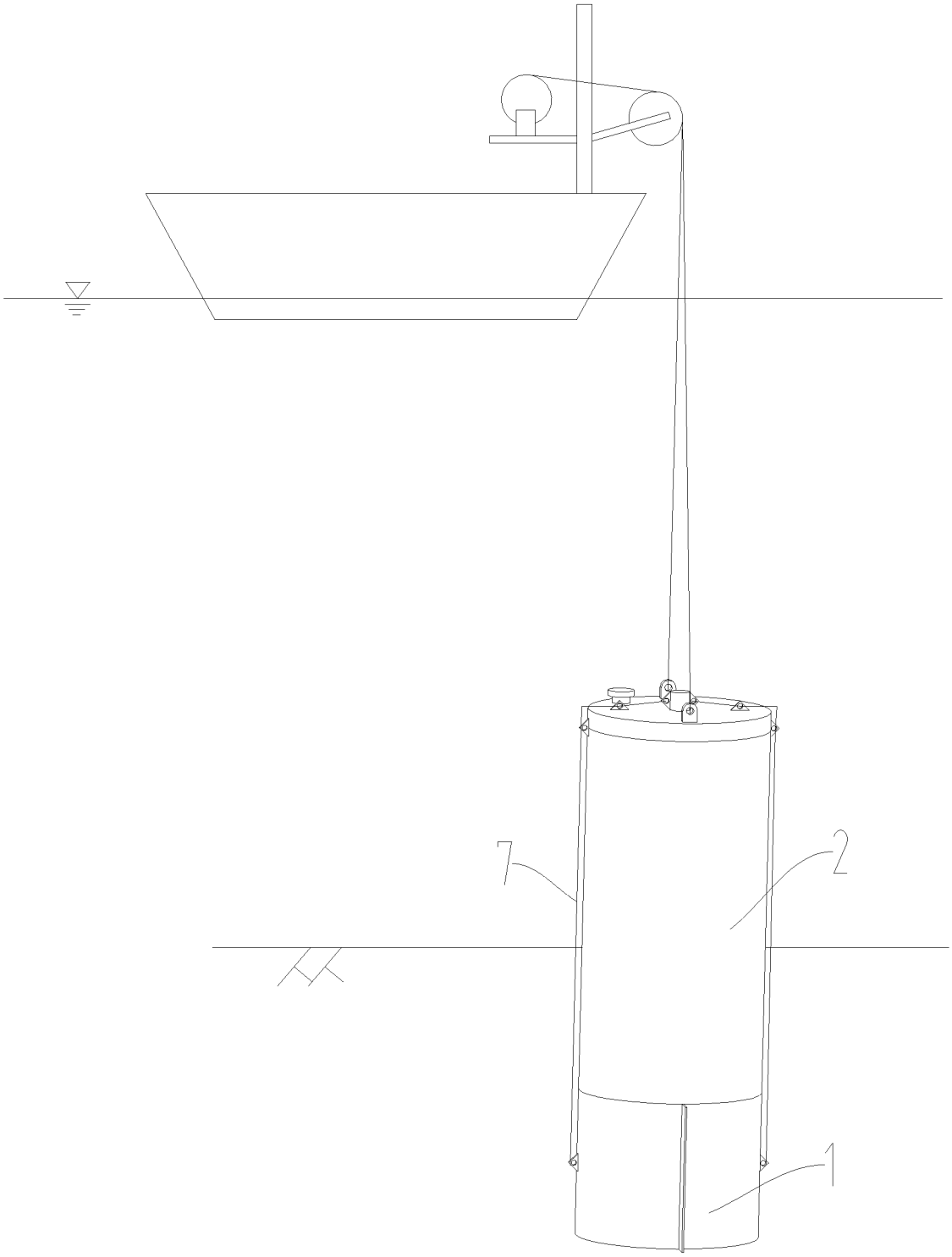
FIG. 5 is a structural schematic view of the annular anchor recycling instrument having sunk into water after butting to the annular anchor in FIG. 4.
Figure 6:
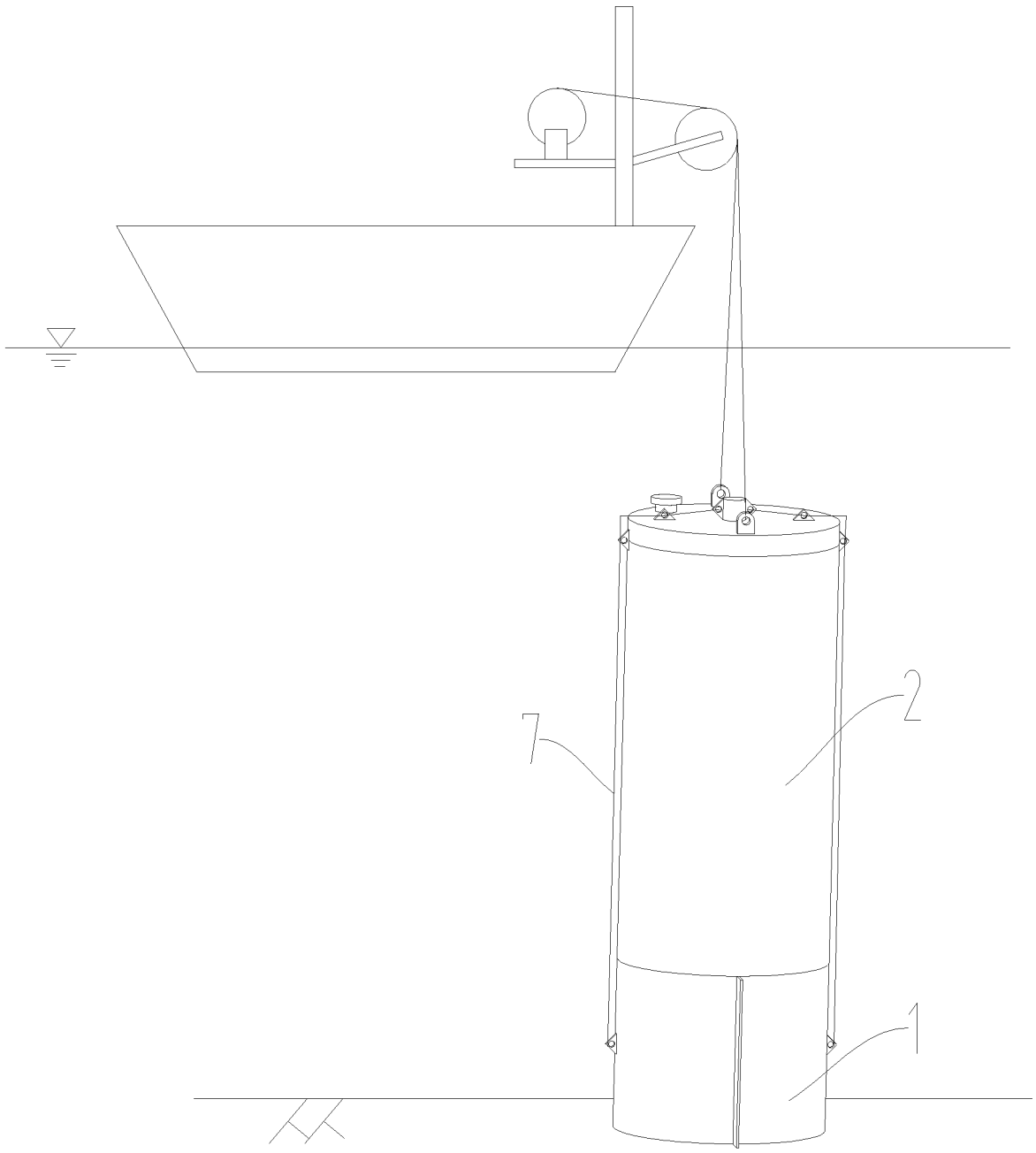
FIG. 6 is a structural schematic view of the recycling tube and the annular anchor being pulled out of the seabed by a hoist.

As shown in FIGS. 4-6, the annular anchor recycling method further provided by this example uses the annular anchor recycling instrument described in the aforementioned example, including the following steps.

Connecting a hoist with the lifting point 5 on the cover body 3, then hoisting the recycling tube 2 into the water to sink it, as shown in FIG. 4.

During the descent, actuating the pump body assembly 4 to drain the water in the recycling tube 2 to form a pressure difference between the inside and outside the recycling tube 2, sinking the recycling tube 2 above the annular anchor to be recycled under the action of the pressure difference, then butting the open end of the recycling tube 2 to the top of the annular anchor, wherein, the recycling tube 2 penetrates above the annular anchor at a speed of not more than 5 m/h.

Connecting the installation point 6 on the cover body 3 with the anchor chain 7 on the annular anchor by means of an underwater robot to fix the annular anchor coaxially to the open end of the recycling tube, as shown in FIG. 5.

Starting the pump body assembly 4 to fill water into the recycling tube 2 for a pressure boost, meanwhile cooperating with a hoist to pull the recycling tube 2 and the annular anchor out of the seabed, as shown in FIG. 6.

The annular anchor recycling instrument is used to sink the recycling tube 2 above the annular anchor 1 by means of a hoist, and fix the annular anchor 1 to the open end of the recycling tube 2 by means of the anchor chain 7; then the pump body assembly 4 starts to fill water and boost pressure, while the hoist lifts the recycling tube 2 and the annular anchor 1 cooperatively and pull them out of the seabed together, so as to recycle them fast and less noisily, and possibly reuse the recycling instrument, reducing costs.

It is obvious that the above description only gives examples for clarity, which does not impose a limitation on their embodiments. A person skilled in the art can make various changes or modifications on the basis of the above description. There is no need and inability to give all exhaustive embodiments. However, the apparent changes or modifications derived therefrom still fall within the protection scope of the present disclosure.

What is claimed is:

1. An annular anchor recycling instrument configured to cooperatively install an annular anchor (1) opened at its upper and lower ends, comprising an recycling tube (2), one end of which is provided with a cover body (3), and the other end of which is configured to be an open end for cooperating with the top of the annular anchor (1);

a pump body assembly (4) arranged on said cover body (3), and used to boost pressure to the interior of said recycling tube (2);

a lifting portion (5) arranged on said cover body (3), and used to connect with a hoist; and an installation portion (6) in multiple groups, which are arranged on said cover body (3), and used to connect with the anchor chain (7) on the annular anchor (1), so that the annular anchor (1) is coaxially fixed to the open end of said recycling tube (2);

wherein the annular anchor recycling instrument further includes a constraint means (8), positioned at the open end of said recycling tube (2), which is used to limit the relative movement between the annular anchor (1) and said recycling tube (2) in the radial direction;

wherein said constraint means (8) includes a constraint plate (9), one end of the constraint plate (9) is connected with the inner wall of the open end of said recycling tube (2), and the other end of the constraint plate (9) is suitable for protruding into the interior of the annular anchor (1), so as to abut on the inner wall of the annular anchor (1);

wherein a bottom end of said constraint plate (9) is provided with a guiding portion (10) bent toward its center.

2. The annular anchor recycling instrument according to The annular anchor recycling instrument according to claim 1, wherein said constraint plates (9) are configured to be in multiple groups, which are spaced along the circumferential direction of said recycling tube (2).

3. The annular anchor recycling instrument according to claim 1, wherein the end face of the open end of said recycling tube (2) and the end face of the annular anchor (1) are butted to each other.

4. The annular anchor recycling instrument according to claim 1, wherein said lifting portions (5) in multiple groups are arranged symmetrically with respect to the circumferential direction of said cover body (3).

5. The annular anchor recycling instrument according to claim 1, wherein said installation portion (6) has multiple groups of installation points, which are arranged sequentially along the binding direction of the anchor chain (7).

6. The annular anchor recycling instrument according to claim 1, wherein the side wall of said recycling tube (2) is provided with tube connecting portions (11), which are arranged in multiple groups in correspondence to said installation portion (6).

7. An annular anchor recycling method using the annular anchor recycling instrument described in claim 1, comprising the steps of:

connecting a hoist with said lifting point (5) on said cover body (3), then hoisting said recycling tube (2) into water to sink it;

during the descent, actuating said pump body assembly (4) to drain water in said recycling tube (2) to form a pressure difference between the inside and outside said recycling tube (2), sinking said recycling tube (2) above the annular anchor to be recycled under the action of the pressure difference, then butting the open end of said recycling tube (2) to the top of the annular anchor;

connecting said installation point (6) on said cover body (3) with the anchor chain (7) on the annular anchor by means of an underwater robot to fix the annular anchor coaxially to the open end of said recycling tube (2); and starting said pump body assembly (4) to fill water into said recycling tube (2) for a pressure boost, meanwhile cooperating with a hoist to pull said recycling tube (2) and the annular anchor out of the seabed.

8. The annular anchor recycling method using the annular anchor recycling instrument described in claim 7, wherein said constraint plates (9) are configured to be in multiple groups, which are spaced along the circumferential direction of said recycling tube (2).

9. The annular anchor recycling method using the annular anchor recycling instrument described in claim 7, wherein the end face of the open end of said recycling tube (2) and the end face of the annular anchor (1) are butted to each other.

10. The annular anchor recycling method using the annular anchor recycling instrument described in claim 7, wherein said lifting portions (5) in multiple groups are arranged symmetrically with respect to the circumferential direction of said cover body (3).

11. The annular anchor recycling method using the annular anchor recycling instrument described in claim 7, wherein said installation portion (6) has multiple groups of installation points, which are arranged sequentially along the binding direction of the anchor chain (7).

12. The annular anchor recycling method using the annular anchor recycling instrument described in claim 7, wherein the side wall of said recycling tube (2) is provided with tube connecting portions (11), which are arranged in multiple groups in correspondence to said installation portion (6).

* * * * *